US006851787B2

(12) United States Patent
Johnson

(10) Patent No.: US 6,851,787 B2
(45) Date of Patent: Feb. 8, 2005

(54) PRINTER SERVICING SYSTEM AND METHOD

(75) Inventor: Bruce G. Johnson, Ridgefield, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 19 days.

(21) Appl. No.: 10/382,650

(22) Filed: Mar. 6, 2003

(65) Prior Publication Data

US 2004/0174408 A1 Sep. 9, 2004

(51) Int. Cl.[7] ..... B41J 2/165

(52) U.S. Cl. ..... 347/22; 347/29; 347/32; 347/33

(58) Field of Search ..... 347/22, 23, 29–35

(56) References Cited

U.S. PATENT DOCUMENTS

| | | | |
|---|---|---|---|
| 4,369,456 A | 1/1983 | Cruz-Uribe et al. | |
| 4,853,717 A | 8/1989 | Harmon et al. | |
| 4,933,015 A | 6/1990 | White | |
| 4,947,190 A | 8/1990 | Mizusawa et al. | |
| 5,040,000 A | 8/1991 | Yokoi | |
| 5,051,761 A | 9/1991 | Fisher et al. | |
| 5,103,244 A | 4/1992 | Gast et al. | |
| 5,115,250 A | 5/1992 | Harmon et al. | |
| 5,146,243 A | 9/1992 | English et al. | |
| 5,155,497 A | 10/1992 | Martin et al. | |
| 5,250,962 A | 10/1993 | Fisher et al. | |
| 5,300,958 A | 4/1994 | Burke et al. | |
| 5,589,865 A | 12/1996 | Beeson | |
| 5,719,602 A | 2/1998 | Hackleman et al. | |
| 5,734,394 A | 3/1998 | Hackleman | |
| 5,742,305 A | 4/1998 | Hackleman | |
| 5,745,133 A | 4/1998 | Hendricks et al. | |
| 5,943,067 A | 8/1999 | Kong | |
| 6,102,518 A | 8/2000 | Taylor | |
| 6,113,216 A | 9/2000 | Wong | |
| 6,123,410 A | 9/2000 | Beerling et al. | |
| 6,135,585 A | 10/2000 | Johnson et al. | |
| 6,155,667 A | 12/2000 | Eckard et al. | |
| 6,179,419 B1 | 1/2001 | Rasmussen et al. | |
| 6,193,357 B1 | 2/2001 | Medin | |
| 6,224,186 B1 | 5/2001 | Johnson et al. | |
| 6,250,738 B1 | 6/2001 | Waller et al. | |
| 6,328,411 B1 | 12/2001 | Taylor et al. | |
| 6,341,845 B1 | 1/2002 | Scheffelin et al. | |
| 6,361,141 B1 * | 3/2002 | Baitz | 347/32 |
| 6,389,241 B1 | 5/2002 | Cernusak et al. | |
| 6,402,290 B1 | 6/2002 | Johnson et al. | |
| 6,409,304 B1 | 6/2002 | Taylor | |
| 6,464,327 B1 | 10/2002 | Eckard et al. | |
| 6,467,874 B1 | 10/2002 | Williams et al. | |

FOREIGN PATENT DOCUMENTS

| | | | |
|---|---|---|---|
| DE | 3817754 A1 | | 11/1989 |
| EP | 0589604 B1 | | 3/1994 |
| EP | 0 786 350 | | 4/2000 |
| GB | 2218049 A | | 11/1989 |
| GB | 2238510 A | | 6/1991 |
| JP | 59-115863 | | 7/1984 |
| JP | 59115863 | * | 7/1984 |
| WO | WO 02/47911 | | 6/2002 |

OTHER PUBLICATIONS

Search Report for Application No. EP 03 02 4380, Bridge, S May 5, 2004.

* cited by examiner

*Primary Examiner*—Shih-Wen Hsieh

(57) ABSTRACT

A printer includes at least one ink applicator supported in a medium-facing position in which the applicator is adapted to face the print medium when the medium is in a transport path and a first servicing tool outside the transport path and facing the at least one ink applicator, while the at least one ink applicator is in the medium-facing position. In one embodiment, the printer includes a medium transport configured to move the medium relative to the at least one ink applicator, wherein the medium transport includes the first servicing tool.

49 Claims, 7 Drawing Sheets

FIG. 11
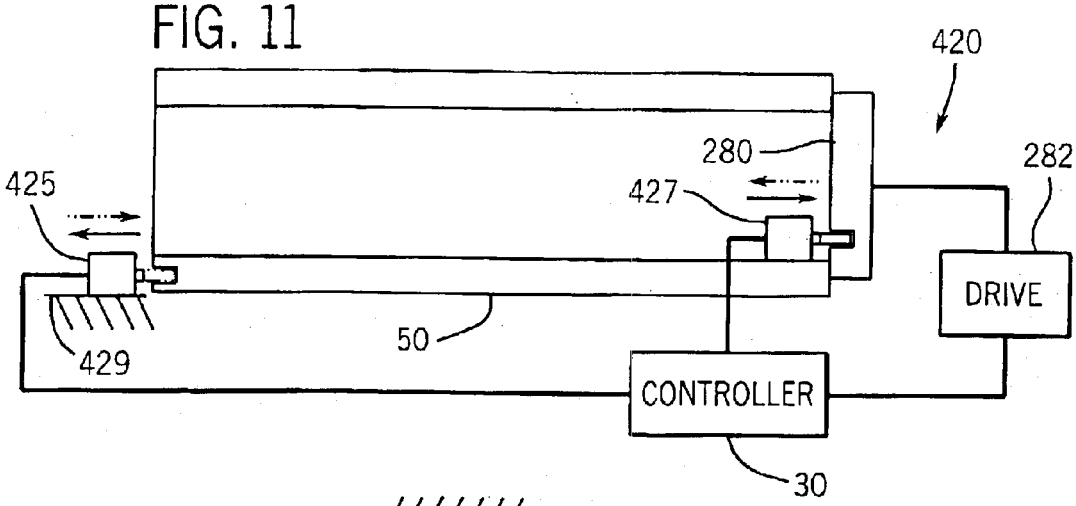
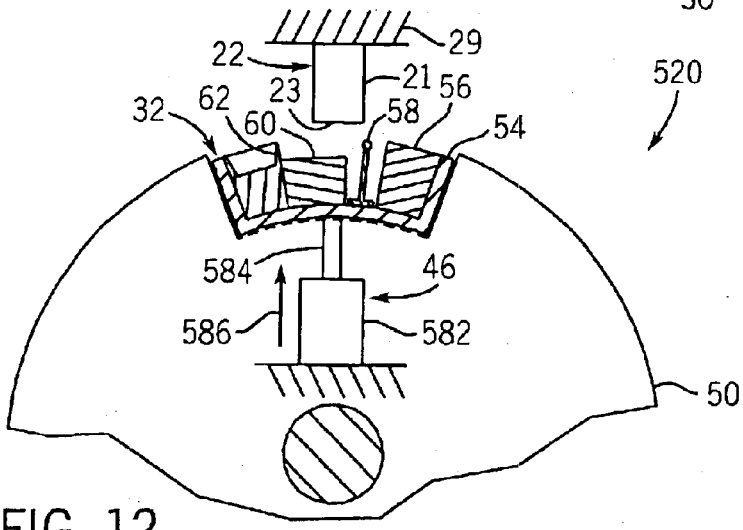
FIG. 12
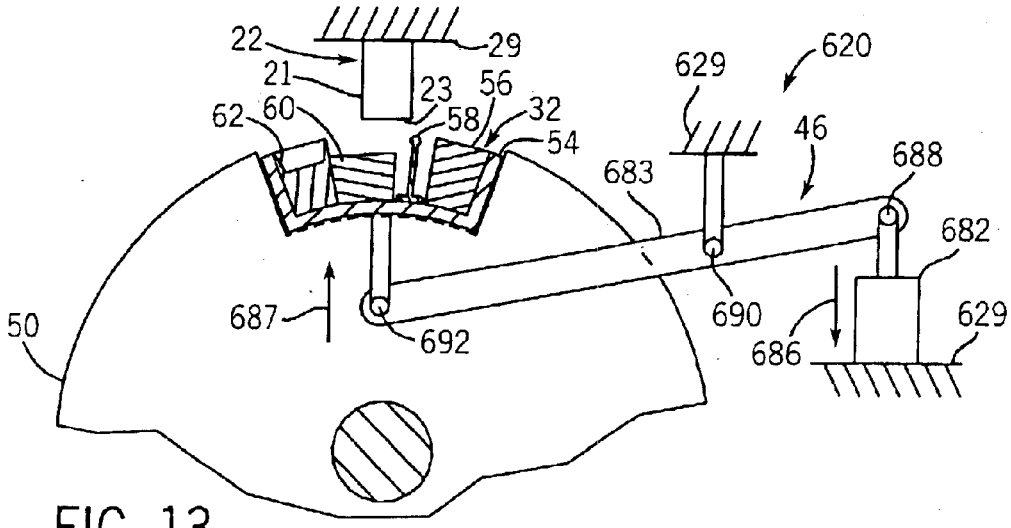
FIG. 13

PRINTER SERVICING SYSTEM AND METHOD

BACKGROUND OF THE INVENTION

One known example of a printer is an ink jet printer in which liquid ink is ejected through multiple nozzles to form characters and graphics on a page. The print quality is dependent upon printer resolution and print head performance. To achieve reliable performance, the ink jet print head and the ink jet process are designed to precisely control ink jet output. By controlling the timing, placement and volume of ink jet output droplets, reliable, repeatable character performance and graphical performance is achieved.

A clogged print head nozzle adversely impacts the placement and volume of inkjet output droplets as the ink droplet may be deflected from its intended destination and less than all ink may escape the nozzle. A seldom used nozzle may get dried ink or contaminants lodged in its orifice. Hot and dry environmental conditions, for example, speed up the drying process and may cause nozzles to clog. Also, contaminants from the external environment or from the printing process may get lodged in a nozzle blocking an orifice. Such clogging may occur despite design efforts to minimize ink drying and maintain a clean print head environment. Accordingly, there is an ongoing need to provide methods and apparatuses for cleaning inkjet print heads.

Current ink jet printers include either scanning-type print heads in which the print head scans a page while ejecting ink droplets or page-wide-array (PWA) print heads which include thousands of nozzles that span generally the entire page-width. With both scanning-type print heads and PWA print heads, cleaning and servicing of the nozzles is typically achieved by moving the print heads to a servicing region where the nozzles are cleaned and capped. Because PWA print heads are generally held stationary relative to the media being printed upon, servicing of the PWA print head requires that the individual nozzles or pens be later precisely reregistered once again with respect to the media or the transports configured to move the media relative to the print head.

One known alternative to moving the PWA print head to a designated service area is to alternatively feed a cleaning media to the print head along the paper path. This method and apparatus are disclosed in U.S. Pat. No. 5,589,865, the full disclosure of which is hereby incorporated by reference.

SUMMARY OF THE INVENTION

According to one embodiment of the present invention, a printer includes at least one ink applicator and a first servicing tool. The at least one ink applicator is supported in a medium-facing position in which the applicator is adapted to face a print medium when the medium is in a transport path. The first servicing tool is located outside the transport path and faces the at least one ink applicator while the at least one ink applicator is in the medium-facing position.

According to another embodiment of the present invention, an ink applicator servicing module is provided for use with a printer having at least one ink applicator supported in a medium-facing position in which the applicator is adapted to face a printing medium while the medium is in a transport path. The module includes a servicing tool configured to be coupled to the printer out of the transport path in an ink applicator-facing position while the at least one ink applicator is in the medium-facing position.

According to another embodiment of the present invention, a method for servicing a printer ink applicator includes the steps of providing at least one servicing tool opposite an ink applicator and out of a medium transport path while the ink applicator is in a print medium-facing position. The method also involves activating the at least one servicing tool to perform at least one servicing operation on the at least one ink applicator.

According to yet another exemplary embodiment of the present invention, a printer includes at least one ink applicator and a medium transport. The at least one ink applicator is supported in a medium-facing position in which the applicator is adapted to face a print medium. The medium transport is configured to move a print medium relative to the at least one ink applicator. The medium transport includes a first servicing tool configured to perform a first servicing operation on the at least one ink applicator.

BRIEF DESCRIPTION OF THE DRAWINGS

FIG. 11 is a schematic illustration of a second alternative embodiment of the system shown in FIG. 4.

FIG. 12 is a schematic illustration of a second preferred embodiment of the system shown in FIG. 3.

FIG. 13 is a schematic illustration of a third preferred embodiment of the system shown in FIG. 3.

DETAILED DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet print head assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
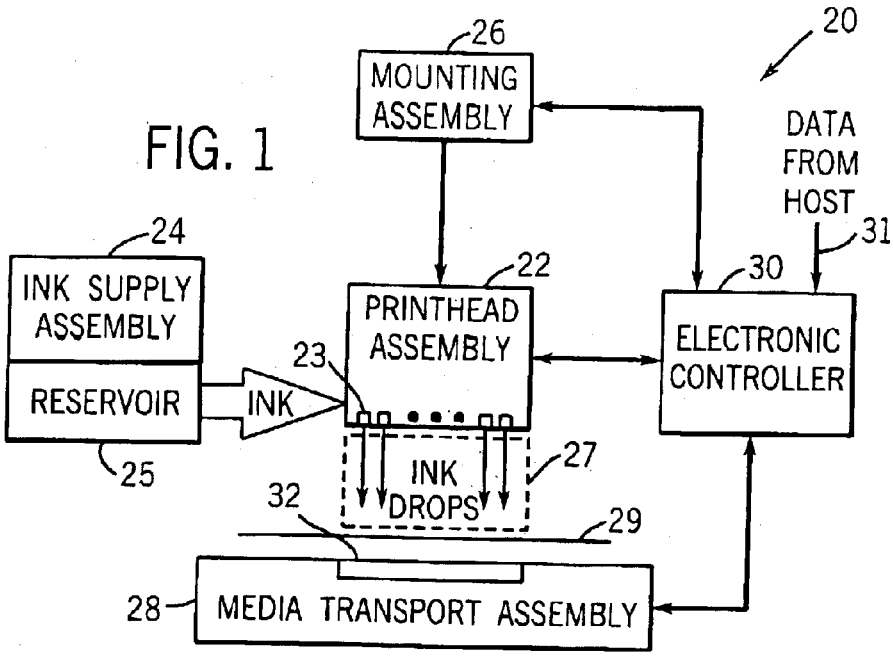
FIG. 1 is a schematic view of one embodiment of an ink jet printing system including a print head assembly and a medium transport assembly.

FIG. 1 illustrates one embodiment of an inkjet printing system 20 according to the present invention. Inkjet printing system 20 includes an inkjet print head assembly 22, an ink supply assembly 24, a mounting assembly 26, a media transport assembly 28, an electronic controller 30 and print head servicing system 32. According to one embodiment, inkjet print head assembly 22 includes one or more ink applicators or print heads 21 (See FIG. 2) which eject drops of ink through a plurality of orifices or nozzles 23 and toward a print medium 29 so as to print onto print medium 29. Print medium 29 is any type of suitable sheet material, such as paper, card stock, transparencies, Mylar, and the like. Typically, nozzles 23 are arranged in one or more columns or arrays such that properly sequenced ejection of ink from nozzles 23 causes characters, symbols, and/or other graphics or images to be printed upon print medium 29 as inkjet print head assembly 22 and print medium 29 are moved relative to each other.

Ink supply assembly 24 supplies ink to print head assembly 22 and includes a reservoir 25 for storing ink. As such, ink flows from reservoir 25 to inkjet print head assembly 22. Ink supply assembly 24 and inkjet print head assembly 22 can form either a one-way ink delivery system or a recirculating ink delivery system. In a one-way ink delivery system, substantially all of the ink supplied to inkjet print head assembly 22 is consumed during printing. In a recirculating ink delivery system, however, only a portion of the ink supplied to print head assembly 22 is consumed during printing. As such, ink not consumed during printing is returned to ink supply assembly 24.

In one embodiment, inkjet print head assembly 22 and ink supply assembly 24 are housed together in an inkjet cartridge or pen. In another embodiment, ink supply assembly 24 is separate from inkjet print head assembly 22 and supplies ink to inkjet print head assembly 22 through an interface connection, such as a supply tube. In either embodiment, reservoir 25 of ink supply assembly 24 may be removed, replaced, and/or refilled. In one embodiment, where inkjet print head assembly 22 and ink supply assembly 24 are housed together in an inkjet cartridge, reservoir 25 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 26 positions inkjet print head assembly 22 relative to media transport assembly 28 to define a print zone 27 adjacent to nozzles 23 in an area between inkjet print head assembly 22 and print medium 29. In one embodiment, inkjet print head assembly 22 is a scanning type print head assembly. As such, mounting assembly 26 includes a carriage for moving inkjet print head assembly 22 relative to media transport assembly 28 to scan print medium 29. In another embodiment, inkjet print head assembly 22 is a non-scanning type print head assembly. As such, mounting assembly 26 fixes inkjet print head assembly 22 at a prescribed position relative to media transport assembly 28. Media transport assembly 28 positions print medium 29 relative to inkjet print head assembly 22. In particular, media transport assembly 28 positions and moves print medium 29 along a transport path 34 (shown in FIG. 2) proximate to print head assembly 22. Transport path 34 generally comprises the volume of space between transport assembly 28 and the print zone 27 in which the medium moves during printing. The transport path generally has a thickness equal to the thickness of medium 29, plus an additional minute thickness above and below the medium. Although transport path 34 is illustrated as being generally planar, transport path 34 may alternatively extend in an arc or may be generally circumferential as when medium 29 is supported about a drum.

Media transport assembly 28 generally comprises an assembly of components configured to move medium 29 in the transport path relative to printer assembly 22. In one embodiment, media transport assembly 28 includes a single drum about which medium 29 is held adjacent nozzles 23. In another embodiment, media transport assembly 28 includes a belt against which medium 29 is held and moved relative to nozzles 23. In still another embodiment, media transport assembly 28 includes one or more rollers which engage and move medium 29 in a generally flat plane either by suspending medium 29 in a plane or by moving medium 29 across a relatively flat or level surface of a platform.

Electronic controller 30 communicates with inkjet print head assembly 22, mounting assembly 26, and media transport assembly 28. Electronic controller 30 receives data 31 from a host system, such as a computer, and includes memory for temporarily storing data 31. Typically, data 31 is sent to inkjet printing system 20 along an electronic, infrared, optical or other information transfer path. Data 31 represents, for example, a document and/or file to be printed. As such, data 31 forms a print job for inkjet printing system 20 and includes one or more print job commands and/or command parameters.

In one embodiment, electronic controller 30 provides control of inkjet print head assembly 22 including timing control for ejection of ink drops from nozzles 23. As such, electronic controller 30 defines a pattern of ejected ink drops which form characters, symbols, and/or other graphics or images on print medium 29. Timing control and, therefore, the pattern of ejected ink drops, is determined by the print job commands and/or command parameters. In one embodiment, logic and drive circuitry forming a portion of electronic controller 30 is incorporated in an integrated circuit (IC) (not shown) located on inkjet print head assembly. In another embodiment, logic and drive circuitry is located off inkjet print head assembly 22.

Printing servicing system 32 is generally located outside the transport path and includes at least one servicing tool configured to perform a servicing operation upon the orifices or nozzles 23 of the ink applicator. Examples of such servicing operations include blotting, wiping, solvent applications and capping. The first servicing tool is generally positioned so as to face the at least one ink applicator while the at least one ink applicator is in a medium-facing position.

Figure 2:
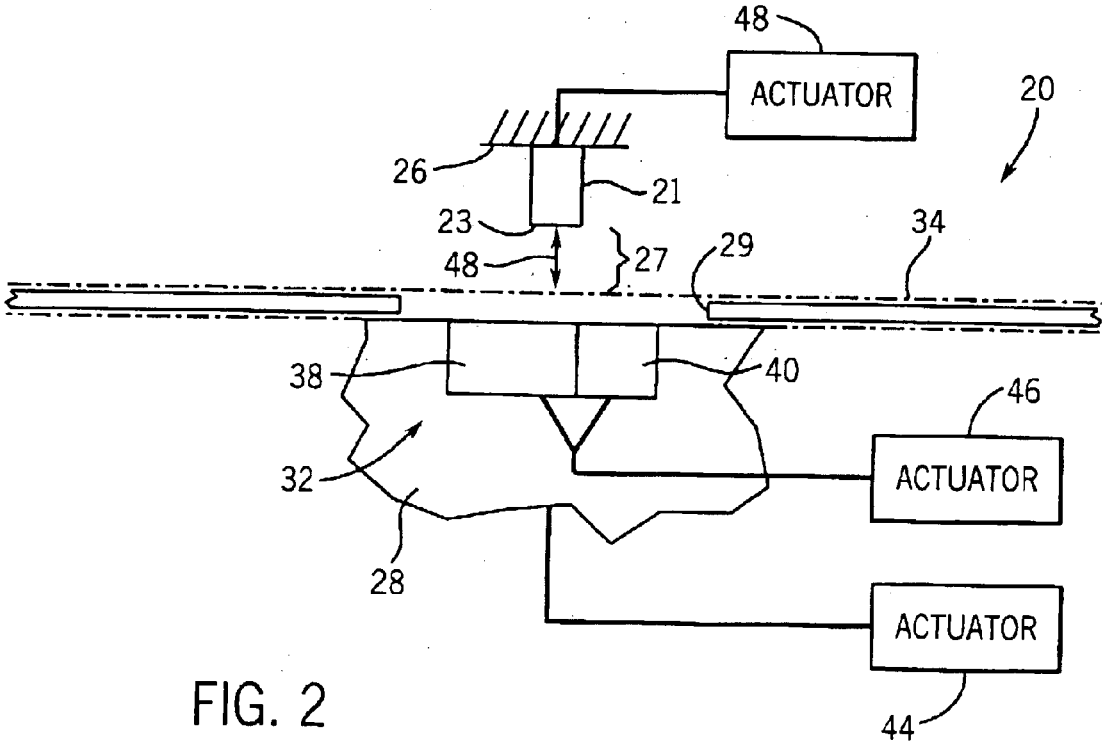
FIG. 2 is an enlarged fragmentary schematic view of the system of FIG. 1.

FIG. 2 schematically illustrates one embodiment of printer or printing system 20 including applicator servicing system 32. As shown by FIG. 2, ink applicator or print head 21 and its nozzle or opening 23 are supported by mounting assembly 26 in a medium-facing position in which applicator 21 faces print medium 29, while medium 29 is in a transport path 34. Servicing system 32 is shown as including servicing tools 38 and 40 which are supported outside transport path 34. Servicing tool 38 is shown facing ink applicator 21. In the particular embodiment illustrated, servicing tools 38 and 40 are supported below transport path 34 such that medium 29 can freely move between transport assembly 28 and applicator 21. In alternative embodiments, this orientation may be modified so long as servicing tools 38 and 40 are supported outside of or beyond transport path 34.

As further shown by FIG. 2, system 20 additionally includes actuators 44, 46 and 48. Actuator 44 generally comprises a conventionally known or future developed mechanism configured to move servicing tools 38 and 40 into and out of an applicator-facing position. FIG. 2 currently illustrates actuator 44 positioning servicing tool 38 in an applicator-facing position, wherein servicing tool 38 is in sufficient alignment with applicator 21 to perform a servicing operation on applicator 21. At the same time, servicing tool 40 is shown out of an applicator-facing position. Actuator 44 selectively moves or actuates servicing tools 38 and 40 into and out of the applicator-facing position to facilitate the performance of different servicing operations upon ink applicator 21. In one embodiment, actuator 44 rotates servicing tools 38 and 40 into and out of the applicator-facing position. In another embodiment, actuator 44 slides or reciprocates tools 38 and 40 into and out of the applicator-facing positions. This movement is performed by mechanical, electrical, pneumatic, hydraulic or other conventionally known or future developed actuation mechanisms. For example, in one embodiment, actuator 44 may comprise an electric solenoid. In other embodiments, actuator 44 may include an electric motor operably coupled to servicing tools 38 and 40. Although less desirable, in those embodiments in which system 20 includes a single servicing tool 38 or a single servicing tool 40, actuator 44 may be omitted.

Actuators 46 and 48 move applicator 21 and at least one of servicing tools 38 and 40 towards one another in the direction indicated by arrows 48. In the particular embodiment illustrated, actuator 48 moves applicator 21 towards transport path 34, while actuator 46 moves a selected one or both of servicing tools 38 and 40 towards applicator 21. As a result, one or both of applicator 21 and servicing tools 38, 40 extend into transport path 34 (when medium 29 is not present). Such movement facilitates engagement of applicator 21 and servicing tool 38 or 40 such that a servicing operation may be performed upon applicator 21.

Actuators 46 and 48 comprise conventionally known or future developed actuation mechanisms configured to move one or more members. For example, actuators 46 and 48 may comprise mechanical devices such as cams and the like, may comprise inflatable bellows, pneumatic or hydraulic cylinder-piston assemblies, solenoids or various other actuation devices. Although system 20 is illustrated as including both actuator 46 and actuator 48, system 20 may alternatively utilize only one of actuator 46 or actuator 48. In one preferred embodiment, actuator 48 is omitted, wherein actuator 46 moves a selected one of tools 38 and 40 into engagement with a stationary applicator 21.

Figure 3:
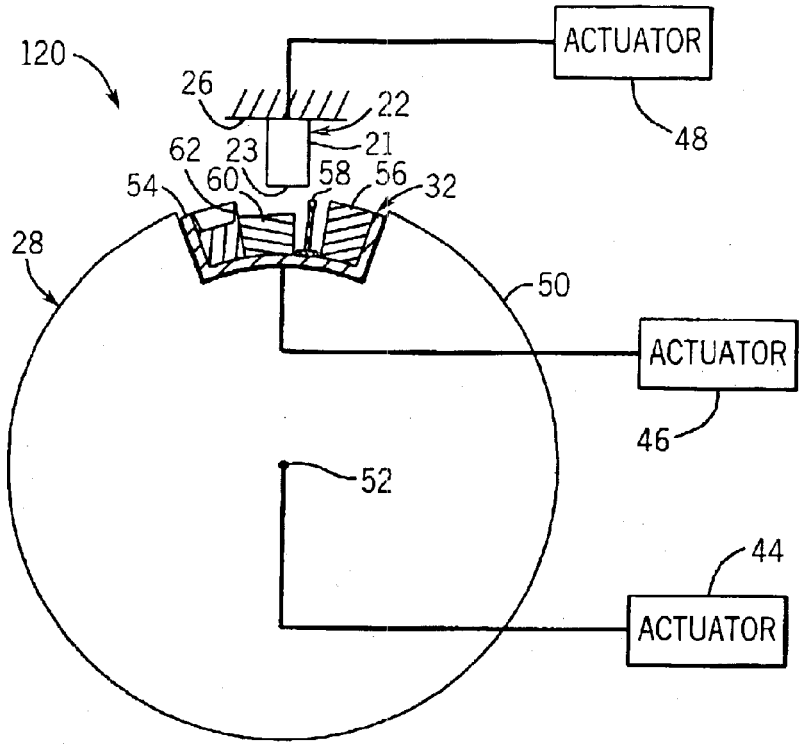
FIG. 3 is an enlarged side elevational view schematically illustrating one preferred embodiment of the system shown in FIGS. 1 and 2 including a medium transport assembly having a drum with a servicing system.

FIG. 3 schematically illustrates ink jet printing system 120, an embodiment of system 20 shown in FIGS. 1 and 2. For ease of illustration, those components of system 120 which correspond to components of system 20 are numbered similarly. As shown by FIG. 3, media transport assembly 28 includes a drum 50 positioned proximate to applicator 21. Drum 50 is configured to rotate about an axis 52 and includes servicing system 32. Rotation of drum 50 about axis 52 selectively repositions servicing system 32 relative to applicator 21. In the particular embodiment illustrated, drum 50 is configured to support medium 29 which is wrapped at least partially about drum 50. In one embodiment, the medium 29 (shown in FIG. 2) is appropriately positioned upon drum 50 so as to not extend substantially across servicing system 32 leaving servicing system 32 out of the transport path. In another embodiment, medium 29 is sufficiently dimensioned so as to extend over system 32, wherein system 32 extends below the medium and out of the transport path. In still another embodiment, drum 50 is configured to simply move a medium in a transport path adjacent to applicator 21, wherein the medium does not wrap about drum 50, but only engages a small portion of drum 50.

As further shown by FIG. 3, servicing system 32 includes base 54 and servicing tools 56, 58, 60 and 62. Base 54 generally comprises a structure configured to support each of tools 56, 58, 60 and 62. In the particular embodiment illustrated, base 54 comprises a sled from which tools 56, 58, 60 and 62 extend. Base 54 is coupled to actuator 46. Actuation of actuator 46 moves base 54 relative to drum 50 to move one or more of tools 56, 58, 60 and 62 towards applicator 21. In particular, after actuator 44 has rotated drum 50 about axis 52 to selectively position one of tools 56, 58, 60 and 62 into an applicator-facing position, actuator 46 moves base 54 relative to drum 50 to move one of the tools into engagement with applicator 21. At the same time, actuator 48 moves applicator 21 towards the servicing tool facing it. In alternative embodiments, actuator 48 may be omitted wherein actuator 46 moves base 54 a sufficient extent so as to move one of tools 56, 58, 60 and 62 into servicing engagement with applicator 21.

Servicing tools 56, 58, 60 and 62 generally comprise tools configured to perform servicing operations upon applicator 21. In the particular embodiment illustrated, servicing tools 56, 58, 60 and 62 are configured to perform distinct servicing operations. Servicing tool 56 comprises a conventionally known fluid applicator configured to apply a fluid, such as solvent, to applicator 21. In one embodiment, servicing tool 56 comprises a solvent pad. The solvent pad is formed of a compliant material having low abrasive characteristics so as not to damage the applicator 21. An exemplary material is a tight-celled foam sponge. A solvent for acting upon the dried ink is impregnated in the solvent pad. The actual solvent used will vary embodiment to embodiment depending on the ink being used by the host printer. As most inkjet printers use water-based inks, the primary solvent typically is water. A surfacant also is included in some embodiments to reduce surface tension and improve dissolution of the dried ink. Reactive solvents, such as polyethylene glycol, also may be used. However, as reactive solvents do not have a long shelf life, they are less desirable for embodiments expected to have a long shelf life.

Servicing tool 58 generally comprises a conventionally known tool configured to wipe the nozzle 23 of applicator 21. In particular, tool 58 includes a compliant or elastomeric blade configured to remove fibers or other foreign material off the surface of nozzle 23. The blade is preferably configured so as to extend above the tip of applicator 21 and then deform as the blade is rotated past applicator 21 by actuator 44. Tool 58 also removes any remaining solvent on applicator 21.

Service tool 60 generally comprises a conventionally known blotter configured to absorb ink fired or spit from applicator 21. In one embodiment, the material of tool 60 comprises a fiber or other absorbing material.

Service tool 62 generally comprises a conventionally known or future developed capper configured to cap applicator 21 at the end of the servicing sequence. The capper positions a rubber cap or an elastomeric cap upon the nozzle 23 to seal applicator 21 to prevent the evaporation of the solvent tearing the pigment or dye of the ink. Prior to further printing, capper 62 removes such caps in a conventionally known manner to enable additional printing.

Tools 56, 58, 60 and 62 are supported circumjacent to one another as part of drum 50 by base 54. In alternative embodiments, base 54 may be omitted wherein tools 56, 58, 60 and 62 are supported circumjacent to one another and are independently movable relative to one another. Tools 56, 58, 60 and 62 illustrate but a few examples of tools for servicing applicator 21. In alternative embodiments, additional or alternative servicing tools may be employed such as vacuum ports and the like. Although less desirable, in some alternative embodiments, one or more of tools 56, 58, 60 and 62 may also be omitted.

Figure 4:
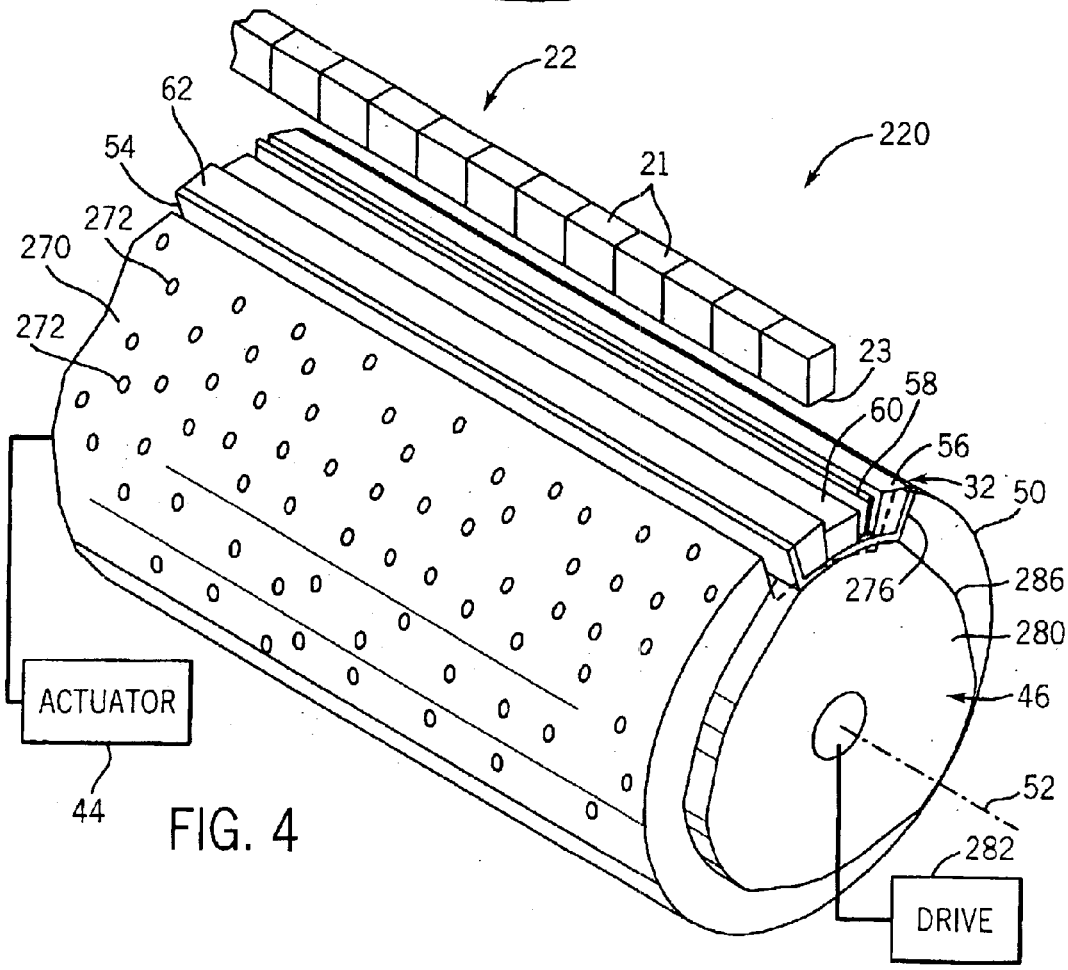
FIG. 4 is a fragmentary perspective view schematically illustrating a first preferred embodiment of the system shown in FIG. 3.

FIG. 4 schematically illustrates system 220, an embodiment of system 120 shown in FIG. 3. For ease of illustration, those components of system 220 which correspond to components of system 120 are numbered similarly. As shown by FIG. 4, printer assembly 22 includes a plurality of ink applicators 21 that extend across substantially an entire dimension (preferably a width) of medium 29 (shown in FIG. 2). In the particular embodiment illustrated in which drum 50 has an axial length along axis 52 that is substantially equal to a width dimension of a widest medium intended for being printed upon by system 220, applicators 21 extend substantially across the entire axial length of drum 50. Although ink applicators 21 are illustrated as forming a single row extending generally parallel to axis 52, ink applicators 21 may alternatively be arranged in a plurality of rows. In the particular embodiment illustrated, ink applicators 21 form a conventionally known page-wide array of print head assembly, wherein each of the ink applicators 21 are configured to operate in an ink-applying state or a non-ink-applying state and wherein each of the applicators 21 are operated independently of one another in both states so as to form a desired image on medium 29. Examples of such page-wide array of print head assemblies and associated components are disclosed in U.S. Pat. Nos. 5,719,602; 5,734,394; 5,742,305; 6,341,845 and 6,467,874, the full disclosures of which are hereby incorporated by reference.

In the embodiment depicted in FIG. 4, drum 50 includes an outer circumferential surface 270 adapted to engage or contact print medium 29 which is at least partially wrapped about drum 50. Outer circumferential surface 270 includes one or more medium retention mechanisms 272. Retention mechanisms 272 are configured to retain a medium 29 along circumferential surface 270 during printing. In the particular embodiment illustrated, medium retention mechanisms 272 comprise a plurality of vacuum ports through which a vacuum source applies a vacuum to medium 29 to hold medium 29 against surface 270. In other embodiments, retention mechanisms 272 may comprise other conventionally known or future developed mechanisms for releasably grasping or retaining medium 29 to hold medium 29 in a relatively stationary position relative to drum 50, whereby the position of medium 29 relative to ink applicators 21 is itself adjusted by the rotation of drum 50 in a conventionally known manner by actuator 44.

In the particular embodiment illustrated, drum 50 has a diameter sufficiently sized such that the largest medium 29 intended to be printed upon by system 220 may be wrapped about drum 50 along portions of outer circumferential surface 270 without overlapping surfacing system 32. As further shown by FIG. 4, base 54 and each of servicing tools 56, 58, 60 and 62 are configured to extend substantially along axis 52 and have an axial length at least equal to that of ink applicators 21. As a result, each servicing tool 56, 58, 60 and 62 may simultaneously service all of ink applicators 21 which extend in a row.

In the particular embodiment illustrated, servicing system 32 is provided in the form of a module 276 that is releasably coupled to the remainder of drum 50. For purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Because tools 56, 58, 60 and 62 are formed as a module that is releasably coupled to the remaining portion of drum 50, such tools may be removed and replaced, repaired or refurbished. In the embodiment shown, each of tools 56, 58, 60 and 62 are supported by base 54 which is removably coupled to the remaining portion of drum 50. Base 54 joins the servicing tools together as a single unit and is movably and releasably retained in an exterior channel 276 formed within circumferential surface 270. In still other alternative embodiments, system 32 may include a plurality of bases 54 which support fewer than all of servicing tools 56, 58, 60 and 62 and which collectively form servicing system 32. For example, system 32 may include a first base 54 supporting tools 56 and 58 and a second base 54 supporting tools 60 and 62, wherein the bases are each releasably coupled to the remainder of drum 50. Although tools 56, 58, 60 and 62 are illustrated as continuously extending in an axial direction, tools 56, 58, 60 and 62 are alternatively composed of a plurality of individual segments of portions extending along axis 52. Although servicing tools 56, 58, 60 and 62 are illustrated as extending generally circumjacent to one another about axis 52, such tools may alternatively be circumferentially spaced from one another about axis 52 along circumferential surface 270 of drum 50.

Figure 4A:
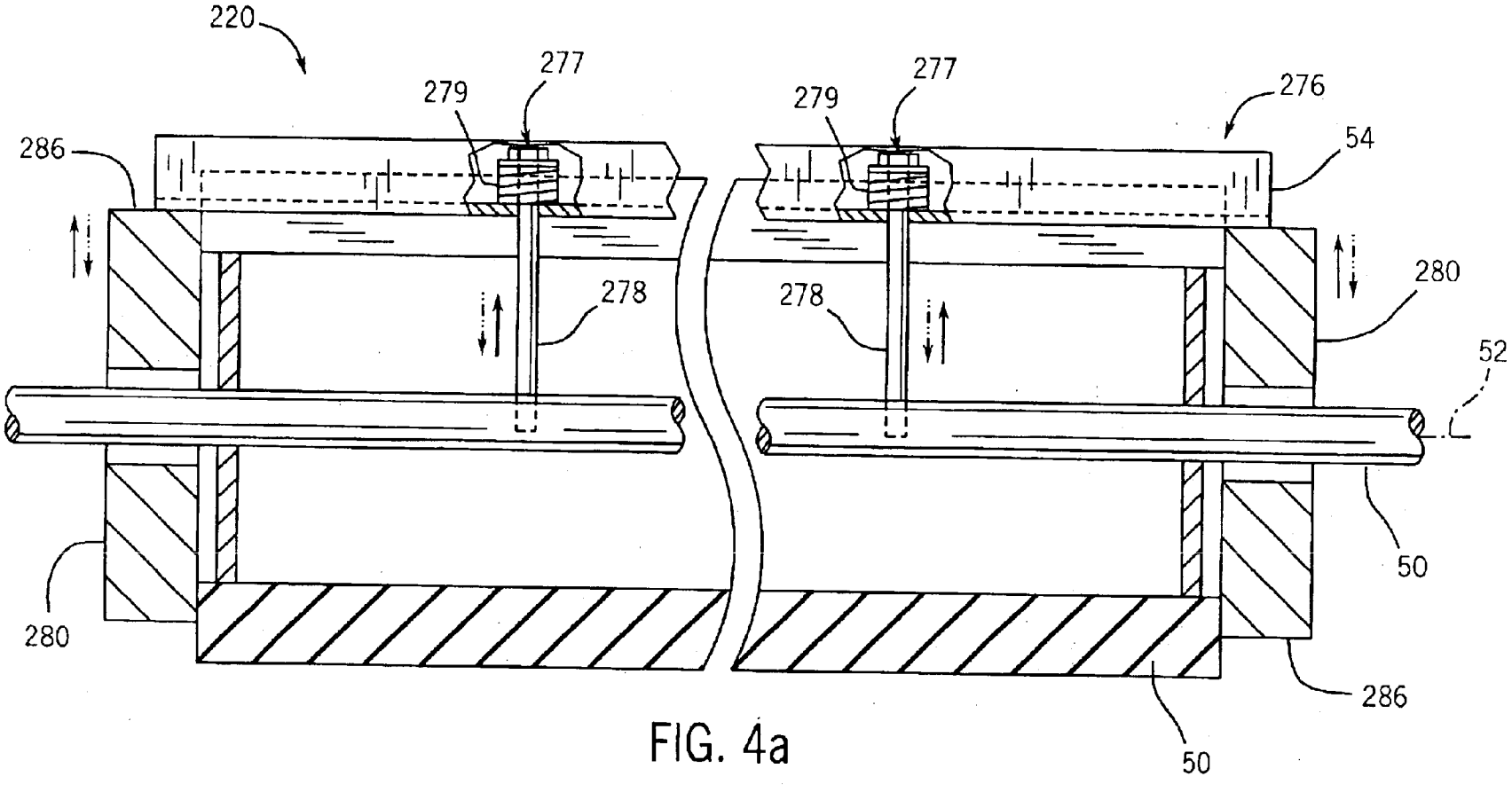
FIG. 4*a* is a sectional view of the system shown in FIG. 4.

As shown by FIG. 4*a*, system 220 additionally includes module retainers 277 which retain modules 276 relative to the remainder of drum 50 while at the same time permitting movement of module 276 in a radial direction as indicated by the arrows shown on FIG. 4*a*. Retainer 277 is enlarged in FIG. 4*a* for purposes of illustration. Retainers 277 generally include guides 278 and biasing members 279. Guides 278 generally comprise structures fixedly coupled to drum 50 and coupled to module 276 so as to permit movement of module 276 in a radial direction while substantially limiting movement of module 276 in a longitudinal or circumferential direction. In the particular embodiment illustrated, guides 278 include shafts or pins fixedly coupled to drum 50 by welding, screw threads or other attachment methods, wherein the shaft or pin passes through an aperture within base 54 and wherein the pin has a terminal end having an enlarged head (provided by a nut and washer) to retain base 54 upon the pin.

Biasing member 279 resiliently biases base 54 towards center line 52. In the particular embodiment illustrated, biasing member 279 comprises a compression spring captured between the head of guide 278 and base 54 of module 276. During movement of base 54 and module 276 in a radially outward direction from center line 52, biasing member 279 is compressed. In returning to its natural state, the spring of biasing member 279 resiliently forces base 54 towards center line 52. Removal of the nut or head portion of guide 278 enables base 54 and module 276 to be lifted and separated from guide 278 for repair or replacement.

Although biasing member 279 is illustrated as being captured between the head of guide 278 and base 54, biasing member 279 may alternatively comprise a torsion spring situated between base 54 and drum 50, wherein movement of module 276 radially away from center line 52 expands or stretches the spring and wherein base 54 is biased towards center line 52 when the spring returns to its natural condition. In lieu of comprising a compression or coiled spring, biasing member 279 may have a variety of other alternative presently known or future developed biasing members.

In still other alternative embodiments, module 276 may be movably retained relative to drum 50 by various other mechanisms. For example, base 54 may alternatively be configured so as to have generally vertical side walls in close tolerance with drum 50 to circumferentially retain module 276 in place during radial movement of module 276. Base 54 may be radially retained relative to drum 50 by a track or tongue-and-groove arrangement formed between base 54 and the surfaces 286 of cams 280 (discussed hereafter). In one embodiment, one of base 54 and cams 280 would have a T-shaped tongue slidably received within a corresponding T-shaped groove extending completely about the opposite surface 286 of the other of base 54 and cam 280 to retain base 54 and module 276 against the exterior surface 286 of cam 280 as cam 280 rotates to radially move base 54 and module 276.

As shown by FIGS. 4 and 4*a*, servicing system 32 of system 220 has an actuator 46 including cams 280 and a schematically illustrated drive 282. Each cam 280 generally includes an exterior cam surface 286 extending at least partially along axis 52 and configured to engage, directly or indirectly, base 54 of servicing system 32. In the particular embodiment illustrated, cams 280 are located axially outside or beyond the ends of drum 50, wherein cam surface 286 engages the corresponding projection or extension extending from base 54 beyond the axial ends of drum 50. In other embodiments, a single cam 280 may extend along the entire axial length of drum 50 radially inward from outer circumferential surface 270. In still other embodiments, cams 280 may be formed inside of and radially inward from circumferential surface 270 of drum 50.

Figure 5:
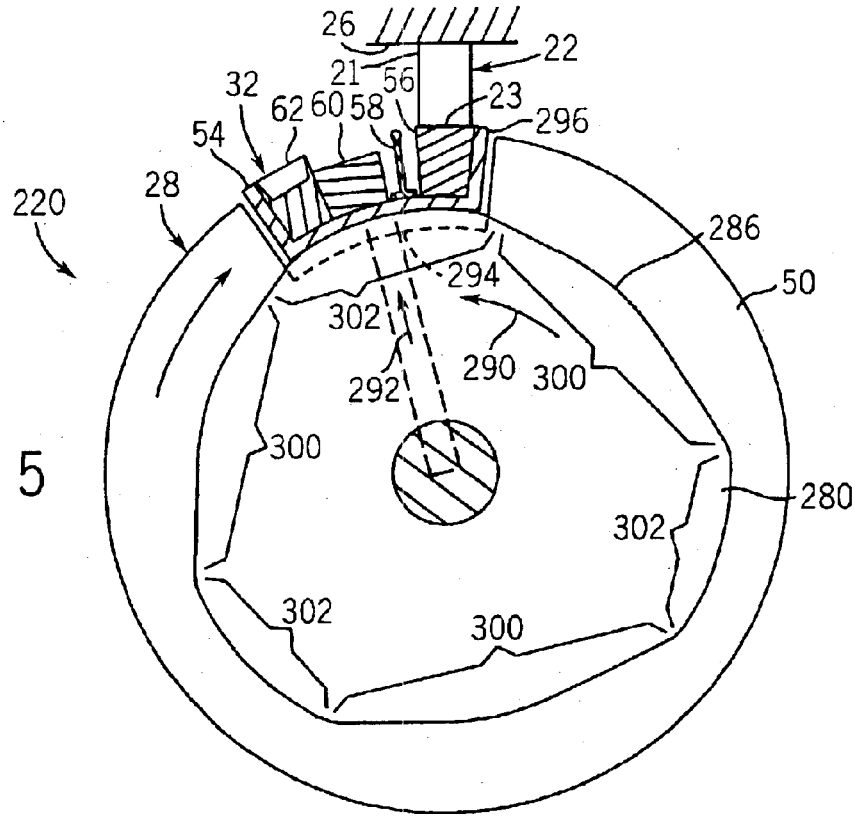
FIGS. 5–9 are side elevational views of the system shown in FIG. 4 illustrating various positions of the servicing system relative to an ink applicator.

As best shown by FIG. 5, exterior cam surface 286 generally includes recessed portions 300 and raised portions 302. Recessed portions 300 are generally configured to engage platform 54 while supporting platform 54 in a radially inward position out of engagement with ink applicator 21. Raised portions 302 are configured to engage and move base 54 to a radially outward position in which one of tools 54, 56, 58 or 62 is in engagement with or in sufficiently close proximity to ink applicator 21 so as to enable the tool to service ink applicator 21. Depressed portions 300 and raised portions 302 may be independently varied depending upon the type of servicing tools, their size or configuration, and the degree of proximity between the servicing tool and ink applicator 21 that is necessary for servicing. Although cam 280 is illustrated as having three depressed portions 300 and three raised portions 302 equi-angularly positioned about axis 52, cam 280 may alternatively have the cam surface 286 have a greater or fewer number of raised and depressed portions, wherein the raised portions and depressed portions need not be equi-angularly spaced about axis 52.

Drive 282 generally comprises a conventionally known or future developed drive mechanism coupled to cams 280 and configured to rotate cams 280. In the particular embodiment illustrated, drive 282 comprises a conventionally known gear driven rotary actuator configured to drive cams 280 about axis 52. Drive 282 simultaneously rotates cams 280 to move base 54 and servicing tools 56, 58, 60 and 62 towards ink applicators 21 in a radial direction from axis 52.

FIGS. 5–9 illustrate the operation of servicing system 32 as part of printing system 220. As shown by FIG. 5, during servicing of print head assembly 22, actuator 44 (shown in FIG. 4) rotatably drives drum 50 to position servicing tool 56 in alignment with ink applicators 21 such that servicing tool 56 faces ink applicators 21. Drive 282 synchronously rotates cams 280 in the direction indicated by arrow 290 to move raised portion 302 of cam surfaces 286 relative to base 54. As a result, raised portion 302 engages base 54 to move base 54 relative to the remainder of drum 50 in a radially outward direction as indicated by arrow 292 from a recessed position shown by phantom lines 294 to a raised position 296 (shown in solid lines) in which servicing tool 56 is configured to engage or is sufficiently proximate to ink applicator 21 such that servicing may be performed upon applicator 21.

Figure 6:
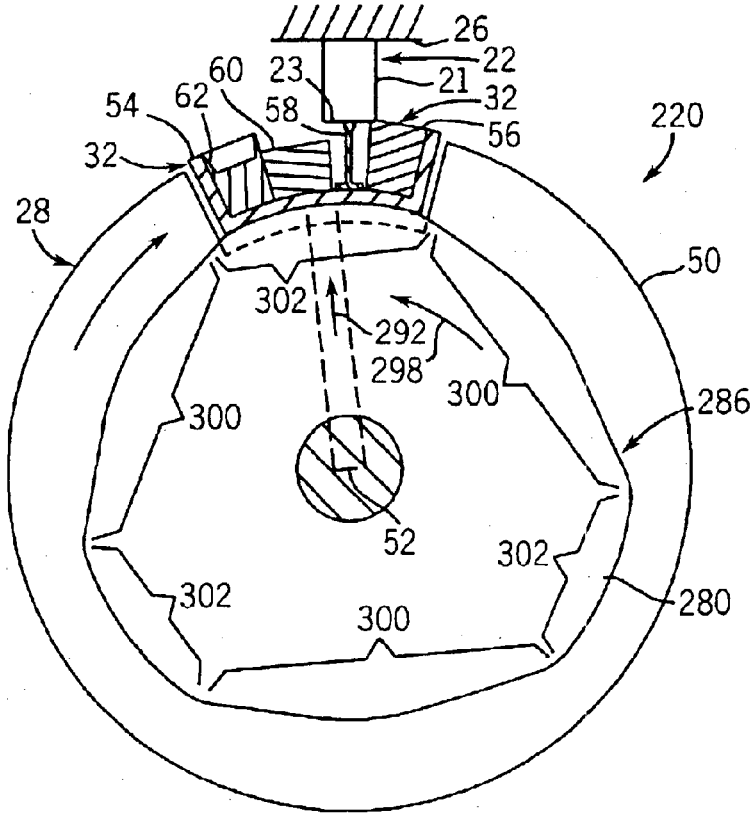

As shown by FIG. 6, once servicing tool 56 has completed servicing operations on ink applicator 21, drive 282 rotatably drives cam 280 relative to base 54 in the direction indicated by arrow 298. As a result, base 54 temporarily engages portion 300 of cam surface 286 which withdraws or retracts base 54 and servicing tool 56 radially inward away from ink applicator 21. Actuator 44 rotates drum 50 to position servicing tool 58 in sufficient alignment with ink applicator 21 such that ink applicator 21 and servicing tool 58 face one another. Drive 282 also rotates cams 280 in the direction indicated by arrow 298 until base 54 is in engagement with portion 302 of cam surfaces 286. As a result, base 54 rides upon portion 302 to move from a retracted position shown in phantom to a raised or elevated position shown in solid in which servicing tool 58 is in engagement with or is sufficiently proximate to ink applicators 21 to enable servicing tool 58 to service ink applicators 21.

Figure 7:
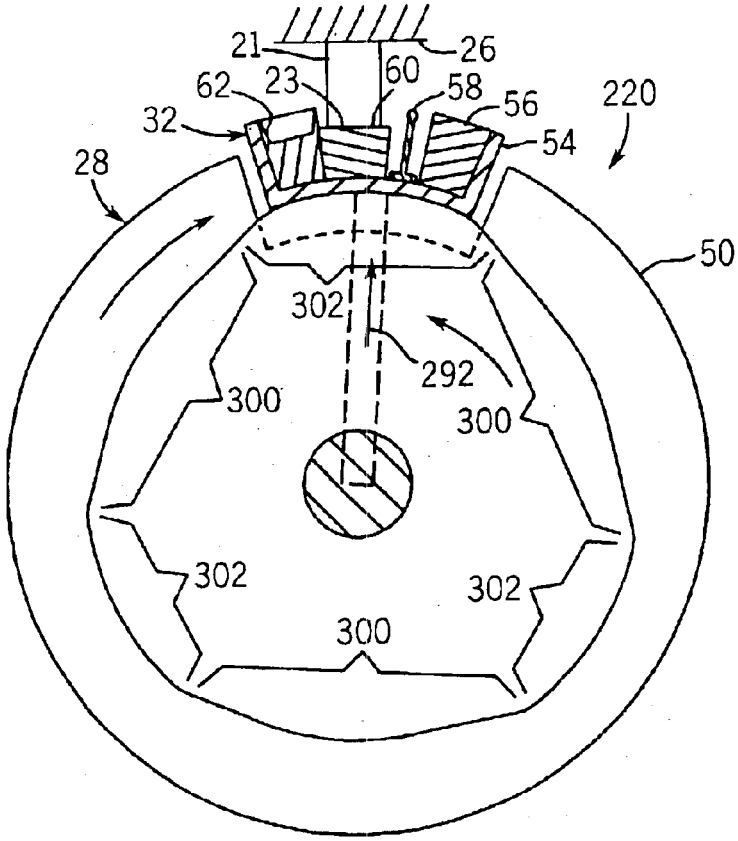
Figure 8:
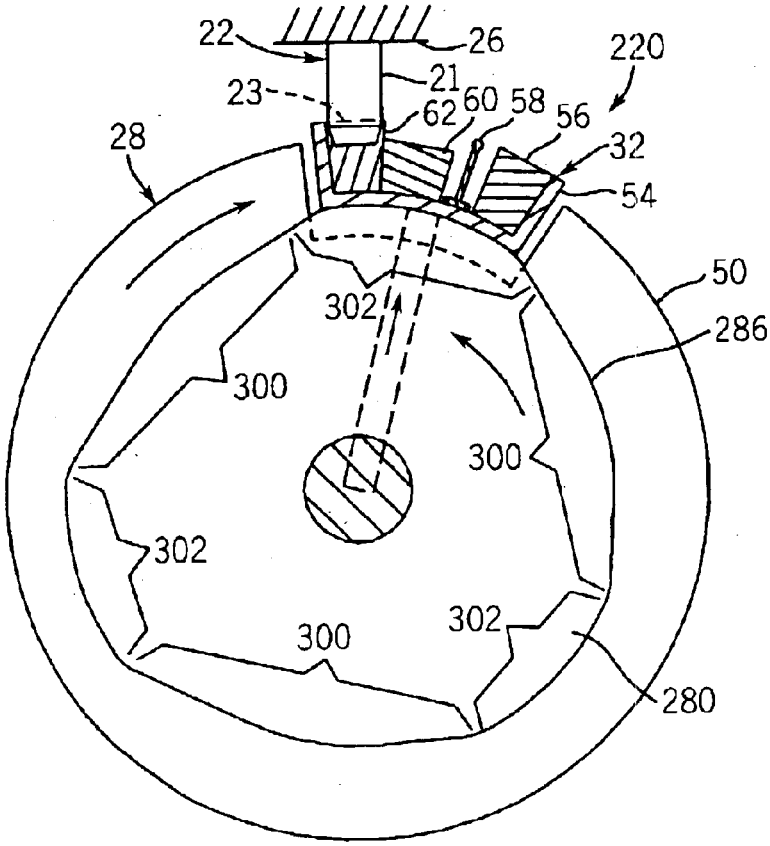

As shown by FIGS. 7 and 8, this process is generally repeated for servicing tools 60 and 62, respectively. In particular, drive 282 rotates cams 280 relative to base 54 which causes base 54 to first retract-or move radially inward as actuator 44 rotates drum 50 to reposition the next successive servicing tool in substantial alignment with ink applicator 21 so as to face ink applicator 21. Drive 282 further rotates cams 280 relative to base 54, out of engagement with recess portion 300, and on to next successive raised portion 302 to once again move the servicing tool radially outward in the direction indicated by arrow 292 to move the servicing tool in engagement with or in sufficient close proximity to ink applicator 21 such that the servicing operation may be performed by the servicing tool upon ink applicator 21.

Figure 9:
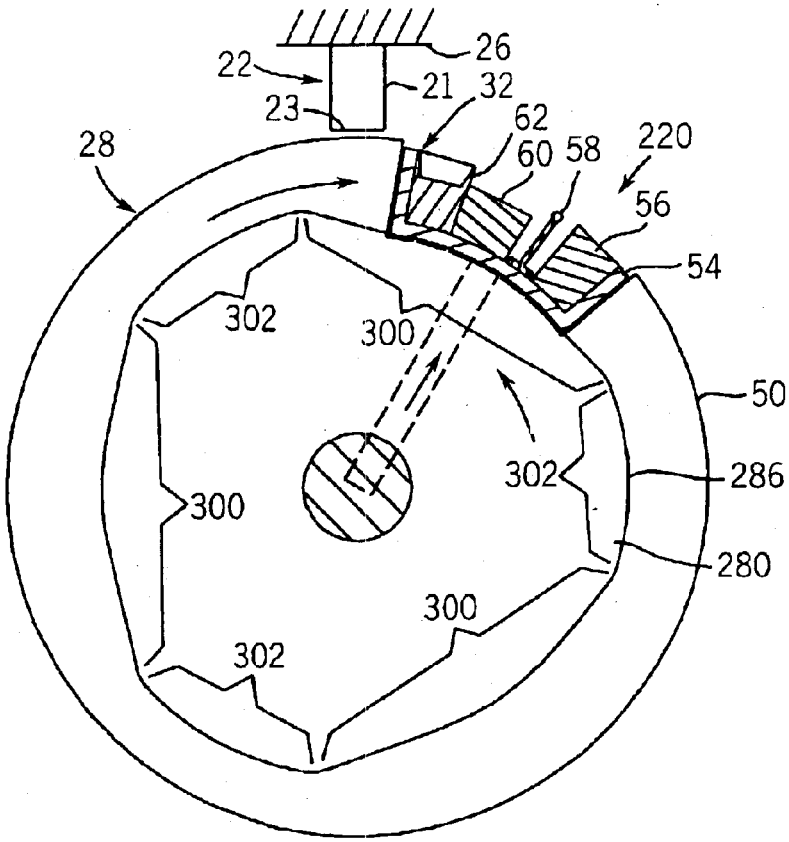

As shown by FIG. 9, once servicing of ink applicator 21 has been completed, drive 282 rotates cams 280 relative to base 54 to position base 54 in engagement with a recess portion 300 of cam surfaces 286. In the particular embodiment illustrated, base 54 and each of servicing tools 56, 58, 60 and 62 are sufficiently recessed relative to outer circumferential service 272 such that the servicing tools do not interfere with ink applicator 21 or medium 29 during the printing operation or by the positioning of paper or medium 29 by medium transport assembly 28 (shown in FIG. 1).

In the particular embodiment illustrated, system 32 is illustrated as utilizing two actuators 44 and 46 including drive 282, wherein actuator 44 moves drum 50 and wherein drive 282 moves cams 280 relative to base 54. However, in other embodiments, system 220 may alternatively employ a single actuator configured to rotatably drive one of cams 280 and drum 50 in conjunction with locking mechanisms configured to selectively lock or retain cam 280 and drum 50 stationary relative to one another. For example, drive 282 may be used to drive both cams 280 and drum 50 when cams 280 and drum 50 are circumferentially fixed to one another by a locking mechanism. Consequently, drive 282 may be used to drive drum 50 during printing, as well as to drive drum 50 during repositioning of the servicing tools opposite ink applicators 21 during servicing. At the same time, by employing an interlock mechanism to retain drum 50 stationary relative to cam 280 will permit drive 282 to rotate cam 280 relative to base 54 to radially move servicing tools towards ink applicator 21. Conversely, actuator 44 may be used to drive drum 50 during printing and during the circumferential repositioning of the servicing tools relative to ink applicator 21 when cams 280 are permitted to rotate with drum 50. Actuator 44 may alternatively be used to rotate base 54 relative to cam surface 286 of cam 280 by rotating drum 50 when cams 280 are fixed or held stationary relative to drum 50 during such rotation. Such releasable locking mechanisms may extend between cams 280 and the remainder of drum 50 and may also extend between one or both of drum 50 and cams 280 into releasable interengagement with the frame or other supporting structure of medium transport assembly 28 supporting drum 50.

Figure 10:
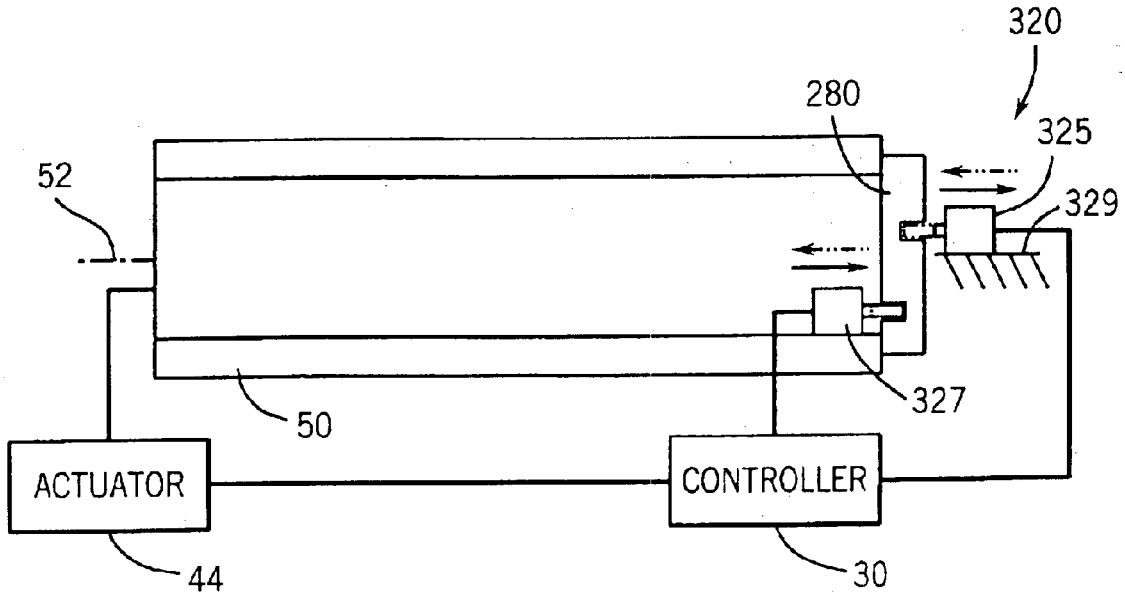
FIG. 10 is a schematic illustration of a first alternative embodiment of the system shown in FIG. 4.

For example, FIG. 10 schematically depicts system 320 employing a single actuator 44 configured to rotatably drive drum 50. System 320 is substantially similar to system 220 except that system 320 additionally includes a single cam 280 and locking mechanisms 325 and 327. FIG. 10 illustrates system 320 in a first position (shown in solid) in which drum 50 and cam 280 are rotated together by actuator 44 and a second position (shown in phantom) in which drum 50 is rotated relative to cam 280. Locking mechanisms 325 and 327 are actuated between the cam-engaging position and the disengaged position by means of controller 30 comprising a control circuit. Locking mechanism 325 generally comprises a member actuatable between a cam engaging position (shown in phantom) and a cam disengaging position (shown in solid). In one embodiment, locking mechanism 325 may comprise an electrically actuated solenoid having a piston or shaft that selectively engages a corresponding detent or bore. In other embodiments, other conventionally known or future developed locking mechanisms may be employed. Locking mechanism 325 is stationarily supported by a frame 329 provided as part of the frame work about drum 50. Locking mechanism 325, when in the cam-engaging position, prevents rotation of cam 280. When in the cam disengaged position, mechanism 325 allows cam 280 to rotate with drum 50.

Locking mechanism 327 is identical to locking mechanism 325, except that locking mechanism 327 is fixed to drum 50. In the cam-engaging position (shown in solid), locking mechanism 327 mechanically locks drum 50 relative to cam 280 such that drum 50 and cam 280 move together. In the cam disengaging position (shown in phantom) actuator 44 rotates drum 50 relative to cam 280.

In lieu of having a piston or shaft which is actuatable so as to selectively project into a corresponding detent of cam 280, locking mechanism 325 and 327 may alternatively be carried by cam 280 wherein the locking mechanism 325 engages a corresponding detent or notches in the stationary frame work about drum 50 and wherein locking mechanism 327 engages a corresponding detent in drum 50. In still other embodiments, locking mechanism 327 may be omitted where cam mechanism 280 is insufficient frictional contact with drum 50 such that the two rotate together about axis 52 when locking mechanism 325 is in the disengaged position.

FIG. 11 illustrates system 420, an alternative embodiment of system 320 shown in FIG. 10. System 420 is similar to system 320 except that system 420 omits actuator 44 and alternatively includes locking mechanisms 425 and 427. FIG. 11 illustrates system 420 in a first position (shown in solid) in which drum 50 and cam 280 are rotated together by drive 282 and a second position (shown in phantom) in which drum 50 is rotated relative to cam 280. Locking mechanism 425 generally comprises a member actuatable between a drum-engaging position (shown in phantom) and a disengaged position (shown in solid). Locking mechanism 425 is stationarily supported along a frame work 429 proximate to drum 50. In the drum-engaging position shown, locking mechanism 425 engages drum 50 to prevent rotation of drum 50. In the particular embodiment illustrated, locking mechanism 425 comprises a solenoid-actuated rod which is extendable into a corresponding groove or detent in drum 50. In alternative embodiments, locking mechanism 425 may be carried by drum 50, wherein the rod is extendable into corresponding groove in structure 429. Locking mechanism 425 is actuatable between the engaged position and the disengaged position in response to control signals from controller 30.

Locking mechanism 427 generally comprises a structure so as to be actuatable between a cam-engaging position (shown in solid) and a cam-disengaged position (shown in phantom). Locking mechanism 427 is stationarily coupled to drum 50. In the cam-engaging position, locking 427 engages cam 280 to lock or retain cam 280 relative to drum 50. In alternative embodiments, locking mechanism 427 may be carried by cam 280 and may include a rod which is extendable into engagement with drum 50 to prevent relative rotation between cam 280 and drum 50. Like locking mechanism 425, locking mechanism 427 is selectively actuated between the engaged position and the disengaged position in response to control signals from controller 30. Although less desirable, locking mechanism 427 may be omitted, wherein cam 280 and drum 50 frictionally engage one another so as to rotate with one another when locking mechanism 425 is in the disengaged position.

FIGS. 12 and 13 illustrate systems 520 and 620, respectively. Systems 520 and 620, which are alternative embodiments of system 220, are substantially identical to system 220, except that systems 520 and 620 include alternative actuators 46. In system 520, actuator 46 includes a linear actuator 582 affixed to drum 50. Linear actuator 582 includes a piston or shaft 584 coupled to base 54 and configured to move base 54 in a radial direction, as indicated by arrow 586. In one embodiment, linear actuator 582 may comprise a solenoid. In another embodiment, linear actuator 582 may comprise a conventionally known or future developed hydraulic or pneumatic cylinder assembly.

System 620 is similar to system 220 except that system 620 has an actuator 46 including linear actuator 682 and lever arm 683. Linear actuator 682 is fixed axially beyond drum 50. Linear actuator 682 is coupled to drum 54 by lever arm 683 which is supported by structure 629. As schematically illustrated, retraction of linear actuator 682 in the direction indicated by arrow 686 causes lever arm to pivot about points 688, 690 and 692 to move drum 54 in the direction indicated by arrow 687. Conversely, the extension of linear actuator 682 moves base 54 away from ink applicator 21. In the particular embodiment illustrated, linear actuator 682 comprises an electric solenoid. In other embodiments, linear actuator 682 may comprise other conventionally known or future developed linear actuators, such as hydraulic or pneumatic cylinder assemblies.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A printer comprising:

at least one ink applicator supported in a medium-facing position in which the applicator is adapted to face a print medium when the medium is in a transport path;

a first servicing tool outside the transport path and facing the at least one ink applicator while the at least one ink applicator is in the medium-facing position; and a medium transport configured to move a print medium relative to the at least one ink applicator, wherein the first servicing tool is carried by the transport.

2. The printer of claim 1, wherein the at least one ink applicator is configured to be held stationary as the at least one applicator applies ink to the medium.

3. The printer of claim 1, wherein the at least one applicator includes a plurality of ink applicators.

4. The printer of claim 3, wherein the plurality of applicators extends substantially across a dimension of the medium.

5. The printer of claim 3, wherein the plurality of ink applicators are configured to operate in an ink-applying state or a non-ink-applying state and wherein the plurality of ink applicators are independently operated in both states so as to form an image on the medium.

6. The printer of claim 3, wherein the first servicing tool is configured to simultaneously service each of the plurality of ink applicators.

7. The printer of claim 1, wherein the first servicing tool is movable into an applicator-facing position and out of the applicator-facing position.

8. The printer of claim 7 including a first actuator configured to move a first servicing tool into the applicator-facing position.

9. The printer of claim 8, wherein the first actuator is configured to rotate the first servicing tool about an axis.

10. The printer of claim 8 including at least one second actuator configured to move at least one of the first servicing tool and the at least ink applicator towards one another.

11. The printer of claim 1 including at least one actuator configured to move at least one of the first servicing tool and the least one ink applicator towards one another.

12. The printer of claim 1 including a second servicing tool configured to perform a servicing function distinct from that of the first servicing tool, wherein each of the first servicing tool and the second servicing tool are movable into an applicator-facing position and out of an applicator-facing position.

13. The printer of claim 1 including a plurality of servicing tools configured to act as blotting for the at least one ink applicator, to wipe the at least one ink applicator, to apply fluid to the at least one ink applicator and to cap the at least one ink applicator, wherein each of the plurality of servicing tools is movable into an applicator-facing position and out of an applicator-facing position.

14. The printer of claim 1, wherein the transport extends proximate to the at least one ink applicator during servicing of the at least one ink applicator by the first servicing tool.

15. The printer of claim 14, wherein the transport extends below the at least one ink applicator during servicing.

16. The printer of claim 1, wherein the transport includes a drum having an outer circumferential surface adapted to engage the print medium.

17. The printer of claim 16, wherein the drum includes a medium retention mechanism along the circumferential surface.

18. The printer of claim 17, wherein the medium retention mechanism includes a plurality of vacuum ports along the circumferential surface.

19. The printer of claim 16, wherein the drum rotates about an axis and wherein the at least one ink applicator includes a plurality of applicators extending along the axis.

20. The printer of claim 19, wherein the first servicing tool extends along the axis.

21. The printer of claim 1, wherein the first servicing tool is selected from a group including:

a blotter;

a wiper;

a fluid applicator; and a capper.

22. The printer of claim 1 including:

a plurality of servicing tools including the first servicing tool; and a base supporting the plurality of servicing tools.

23. The printer of claim 22 including:

an actuator configured to move the base between a servicing position in which at least one of the plurality of tools engages the at least one ink applicator and a resting position in which a plurality of tools are out of engagement with the at least one applicator.

24. The printer of claim 23, wherein the actuator includes at least one cam surface in engagement with the base, wherein relative movement between the cam surface and the base moves the base and each of the tools supported by the base.

25. The printer of claim 24 including a drum configured to rotate about an axis and wherein the at least one cam surface extends along the axis.

26. The printer of claim 24 including a retainer configured to longitudinally and circumferentially retain the base relative to the drum while permitting radial movement of the base relative to the drum.

27. The system of claim 24, wherein the at least one cam surface is configured to move the base at different extents to accommodate different servicing tools.

28. The printer of claim 1 including a plurality of servicing tools including the first servicing tool, wherein the plurality of servicing tools are resiliently biased away from the transport path.

29. The printer of claim 1 including:

a print medium supporting surface adjacent the transport path; and a cam configured to rotate relative to the medium supporting surface, wherein rotation of the cam relative to the medium supporting surface moves the first servicing tool towards and away from the medium supporting surface and the at least one ink applicator.

30. An ink applicator servicing module for use with a printer having at least one ink applicator supported in a medium-facing position in which the applicator is adapted to face a printing medium while the medium is in a transport path, the module comprising:

a first servicing tool configured to be coupled to the printer out of the transport path in an ink applicator-facing position while the at least one ink applicator is in the medium-facing position; and abase removably coupled to the printer and supporting a plurality of servicing tools including the first servicing tool.

31. The module of claim 30, wherein the first servicing tool is selected from a group of tools including:

a blotter;

a wiper;

a fluid applicator; and a capper.

32. The module of claim 30, wherein the printer includes a print medium transport configured to move a print medium relative to the at least one ink applicator and wherein the first servicing tool is configured to be carried by the transport.

33. The module of claim 32, wherein the medium transport includes a drum having an outer circumferential surface, at least a portion of which is configured to engage the print medium, and wherein the first servicing tool is supported along the outer circumferential surface of the drum.

34. The module of claim 33 including a second servicing tool circumjacent the first servicing tool, wherein the second servicing tool is configured to perform a servicing function distinct from that of the first servicing tool.

35. The module of claim 30, wherein the at least one ink applicator includes a plurality of ink applicators configured to extend substantially across a dimension of the print medium and wherein the first servicing tool is configured to simultaneously service each of the plurality of ink applicators.

36. A method for servicing a printer ink applicator, the method comprising:

providing at least one servicing tool on a medium transport configured to move print medium relative to the ink applicator;

positioning the at least one servicing tool opposite an ink applicator and out of a medium transport path while the ink applicator is in a print medium-facing position;

activating the at least one servicing tool to perform at least one servicing operation on the ink applicator; and moving the at least one servicing tool to an ink applicator facing position while the ink applicator is in the medium-facing position.

37. The method of claim 36 including moving at least one of the at least one servicing tool and the ink applicator towards one another while the ink applicator is in the medium-facing position and while the at least one servicing tool is facing the ink applicator.

38. The method of claim 36, wherein the at least one servicing tool includes a plurality of servicing tools configured to perform distinct servicing operations and wherein the method further includes selectively moving each of the plurality of servicing tools into an applicator-facing position and out of the applicator-facing position.

39. The method of claim 36, wherein the method further includes activating the at least one servicing tool to simultaneously service a plurality of ink applicators.

40. A printer comprising:

at least one ink applicator supported in a medium-facing position in which the applicator is adapted to face a print medium; and a medium transport configured to move a print medium relative to the at least one ink applicator, the medium transport including and carrying a first servicing tool configured to perform a first servicing operation on the at least one ink applicator.

41. The printer of claim 40, wherein the applicator is adapted to face a print medium when the medium is in a transport path and wherein the first servicing tool is outside the transport path and facing the at least one ink applicator while the at least one ink applicator is in the medium-facing position.

42. The printer of claim 40, wherein the transport includes a drum configured to rotate about an axis.

43. The printer of claim 40, wherein the transport includes a second servicing tool configured to perform a second servicing operation distinct from that of the first servicing operation.

44. The printer of claim 43, wherein each of the first servicing tool and the second servicing tool are movable into an applicator-facing position and out of an applicator-facing position.

45. The printer of claim 40 including at least one actuator configured to move at least one of the first servicing tool and the at least one ink applicator towards one another while the first servicing tool faces the applicator.

46. The printer of claim 40, wherein the at least one ink applicator includes a plurality of applicators extending along an axis.

47. The printer of claim 40, wherein the transport includes a base supporting the first servicing tool and wherein the printer further includes an actuator configured to move the base between a servicing position in which the first servicing tool engages the at least one ink applicator and a resting position in which the first servicing tool is out of engagement with the at least one ink applicator.

48. A printer comprising:

at least one ink applicator supported in a medium-facing position in which the applicator is adapted to face a print medium when the medium is in a transport path;

a plurality of servicing tools including a first servicing tool outside the transport path and facing the at least one ink applicator while the at least one ink applicator is in the medium-facing position;

a base supporting the plurality of servicing tools;

an actuator configured to move the base between a servicing position in which at least one of the plurality of tools engages the at least one ink applicator and a resting position in which a plurality of tools are out of engagement with the at least one applicator, wherein the actuator includes at least one cam surface in engagement with the base and wherein relative movement between the cam surface and the base moves the base and each of the tools supported by the base.

49. A printer comprising:

at least one ink applicator supported in a medium-facing position in which the applicator is adapted to face a print medium when the medium is in a transport path;

a plurality of servicing tools including a first servicing tool outside the transport path and facing the at least one ink applicator while the at least one ink applicator is in the medium-facing position;

a base supporting the plurality of servicing tools;

an actuator configured to move the base between a servicing position in which at least one of the plurality of tools engages the at least one ink applicator and a resting position in which a plurality of tools are out of engagement with the at least one applicator, wherein the actuator includes at least one cam surface in engagement with the base and wherein the at least one cam surface is configured to move relative to the base at different extents to accommodate different servicing tools.

* * * * *